US006848657B2

(12) United States Patent
Young et al.

(10) Patent No.: US 6,848,657 B2
(45) Date of Patent: Feb. 1, 2005

(54) DYNAMIC SELF-TEACHING TRAIN TRACK LAYOUT LEARNING AND CONTROL SYSTEM

(75) Inventors: Neil Young, Redwood City, CA (US); Louis G. Kovach, II, Belleville, MI (US)

(73) Assignee: The Creative Train Company, LLC, Beverly Hills, CA (US)

( * ) Notice: Subject to any disclaimer, the term of this patent is extended or adjusted under 35 U.S.C. 154(b) by 0 days.

(21) Appl. No.: 10/346,558

(22) Filed: Jan. 16, 2003

(65) Prior Publication Data

US 2003/0155470 A1 Aug. 21, 2003

Related U.S. Application Data

(60) Provisional application No. 60/349,851, filed on Jan. 17, 2002.

(51) Int. Cl.[7] ..... B61L 25/00

(52) U.S. Cl. ..... 246/1 R; 246/122 A; 701/35; 340/995.17

(58) Field of Search ..... 246/182 C, 122 A, 246/124, 122 R, 4, 5, 108, 123, 162, 220; 701/19, 35; 346/8; 340/995.1, 995.16, 995.17, 995.18

(56) References Cited

U.S. PATENT DOCUMENTS

| | | | | |
|---|---|---|---|---|
| 4,349,196 A | * | 9/1982 | Smith et al. | 463/6 |
| 4,977,618 A | | 12/1990 | Allen | |
| 5,064,502 A | | 11/1991 | Turner | |
| 5,247,380 A | | 9/1993 | Lee et al. | |
| 5,319,487 A | | 6/1994 | Sato et al. | |
| 5,364,047 A | * | 11/1994 | Petit et al. | 246/122 R |
| 5,398,894 A | * | 3/1995 | Pascoe | 246/28 R |
| 5,416,627 A | | 5/1995 | Wilmoth | |
| 5,441,223 A | | 8/1995 | Young et al. | |

(List continued on next page.)

OTHER PUBLICATIONS

"TDA2320 Preamplifier for Infrared Remote Control Systems," product information SGS–Thomson Microelectronics (1997).

"TFDU4100/TFDS4500/FFDT4500 2.7 to 5.5 V Serial Infrared Transceiver Module Family (SIR, 115.2 Kbit/s)," product information Vishay Telefunken (1999).

Wigmore "The Digital Model Train Part 11—The Monitor Unit," Elektor Electronics Feb. 1990.

Wigmore "The Digital Model Train Part 12—Address Display," Elektor Electronics Mar. 1990.

*Primary Examiner*—Mark T. Le
(74) *Attorney, Agent, or Firm*—Townsend and Townsend and Crew LLP

(57) ABSTRACT

A method and apparatus for determining a model vehicle layout by moving a vehicle around the track and noting when the vehicle passes track position detection elements. The vehicle can either detect the position detection elements, or the position detection elements can be sensors which detect the vehicle. By noting the order of the position detection elements as detected, and the direction of the vehicle, the layout of the track can be determined. In one embodiment, the position detection elements are sensors along the track which detect an emitted ID from the vehicle, and also detect the speed and direction of the vehicle. This information is then relayed to a control system. In another embodiment, the vehicle detects the position detection element, and relays this information, along with the train ID, speed and direction, to the control system. In another aspect of the invention, a particular type of vehicle at a particular location can be identified, and can be used to selectively operate accessories adjacent that portion of the track. The invention also can provide automated route generation, the route between A and B meeting input route parameters (e.g., backing into destination) can be automatically determined. Also, default accessory and switch selection can be automatically provided to a hand-held controller based on what the vehicle is approaching.

13 Claims, 16 Drawing Sheets

U.S. PATENT DOCUMENTS 5,475,381 A 12/1995 Williamson et al.
5,492,290 A 2/1996 Quinn et al.
5,621,384 A 4/1997 Crimmins et al.
5,638,522 A * 6/1997 Dunsmuir et al. ..... 345/763
5,678,789 A 10/1997 Pipich
5,740,547 A * 4/1998 Kull et al. ..... 701/19
5,749,547 A 5/1998 Young et al.
5,764,395 A 6/1998 Iwata
5,803,411 A * 9/1998 Ackerman et al. ..... 246/169 R
5,855,004 A * 12/1998 Novosel et al. ..... 704/272
5,873,765 A 2/1999 Rifkin et al.
5,890,682 A 4/1999 Welk
5,893,043 A * 4/1999 Moehlenbrink et al. .... 701/207
5,969,842 A 10/1999 Crimmins et al.
6,195,023 B1 * 2/2001 Walsh et al. ..... 340/988
6,293,205 B1 9/2001 Butler
6,417,765 B1 7/2002 Capanna
6,434,452 B1 * 8/2002 Gray ..... 701/19
6,445,150 B1 * 9/2002 Tanner et al. ..... 318/280
6,460,467 B2 10/2002 Katzer
6,480,766 B2 11/2002 Hawthorne et al.

* cited by examiner

FIG - 1
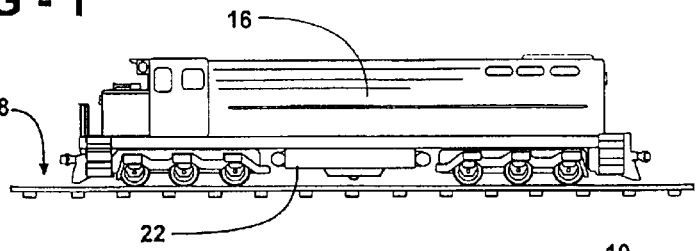
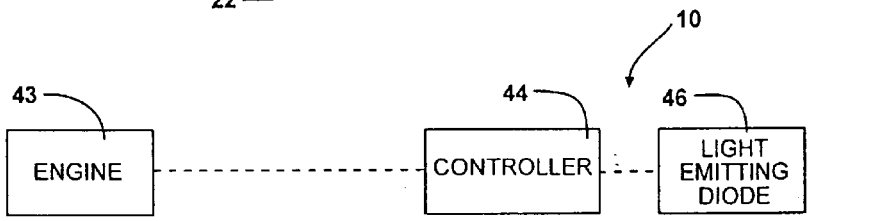
FIG - 2
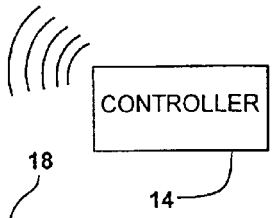
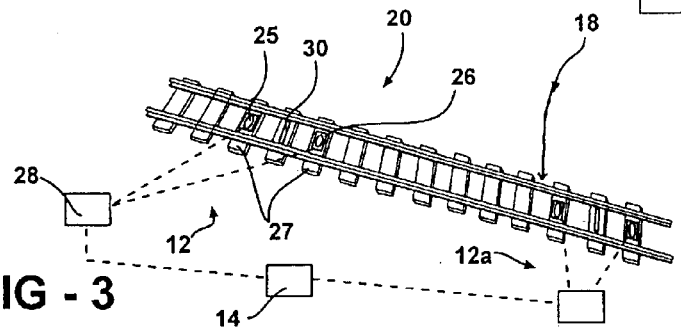
FIG - 3
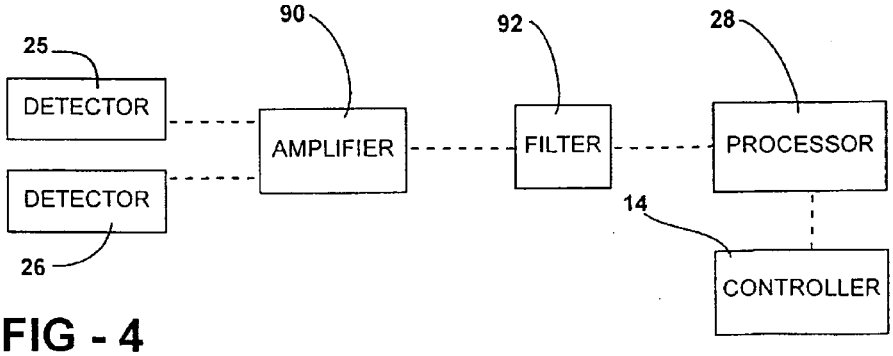
FIG - 4

FIG - 5-A
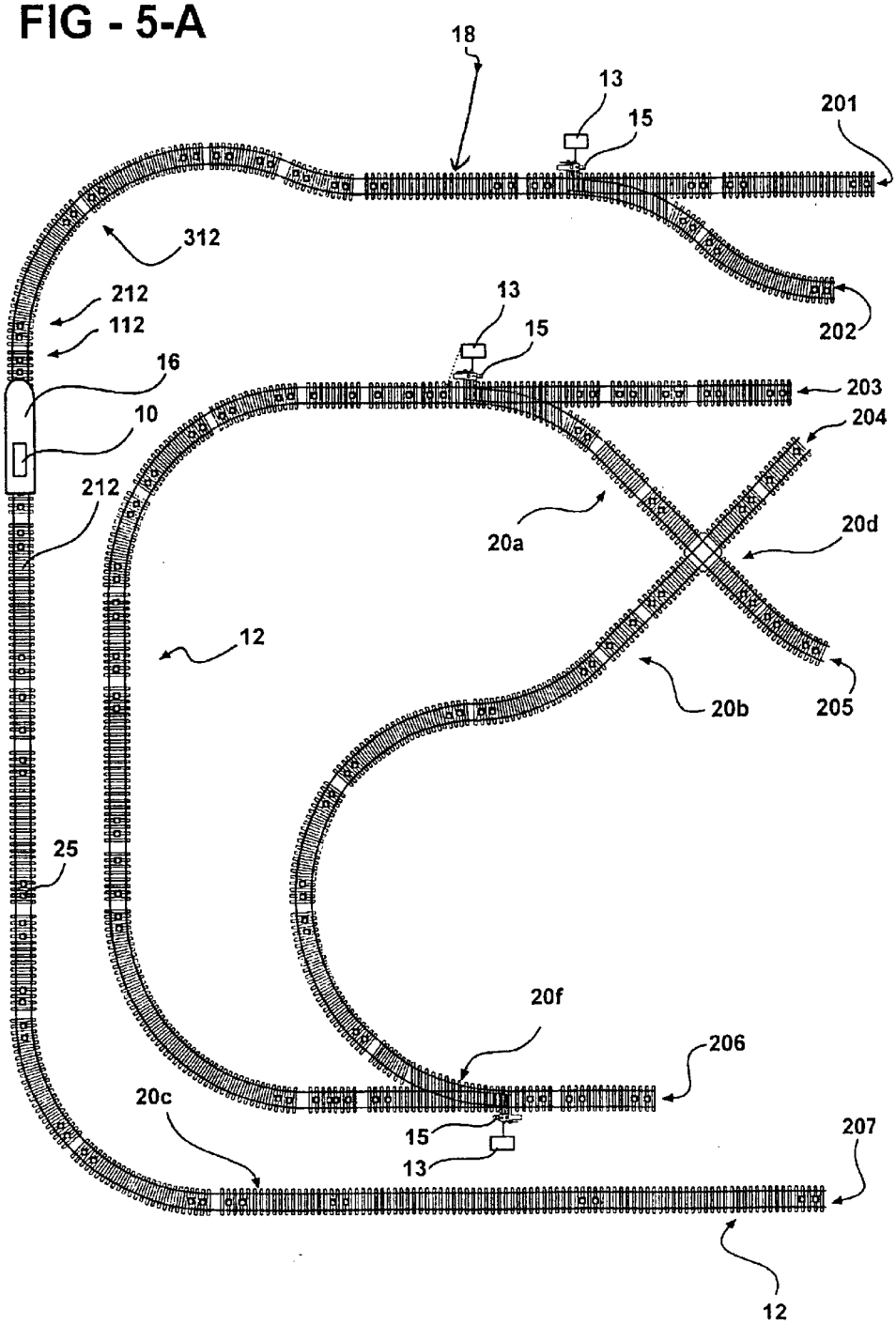

FIG - 5-B
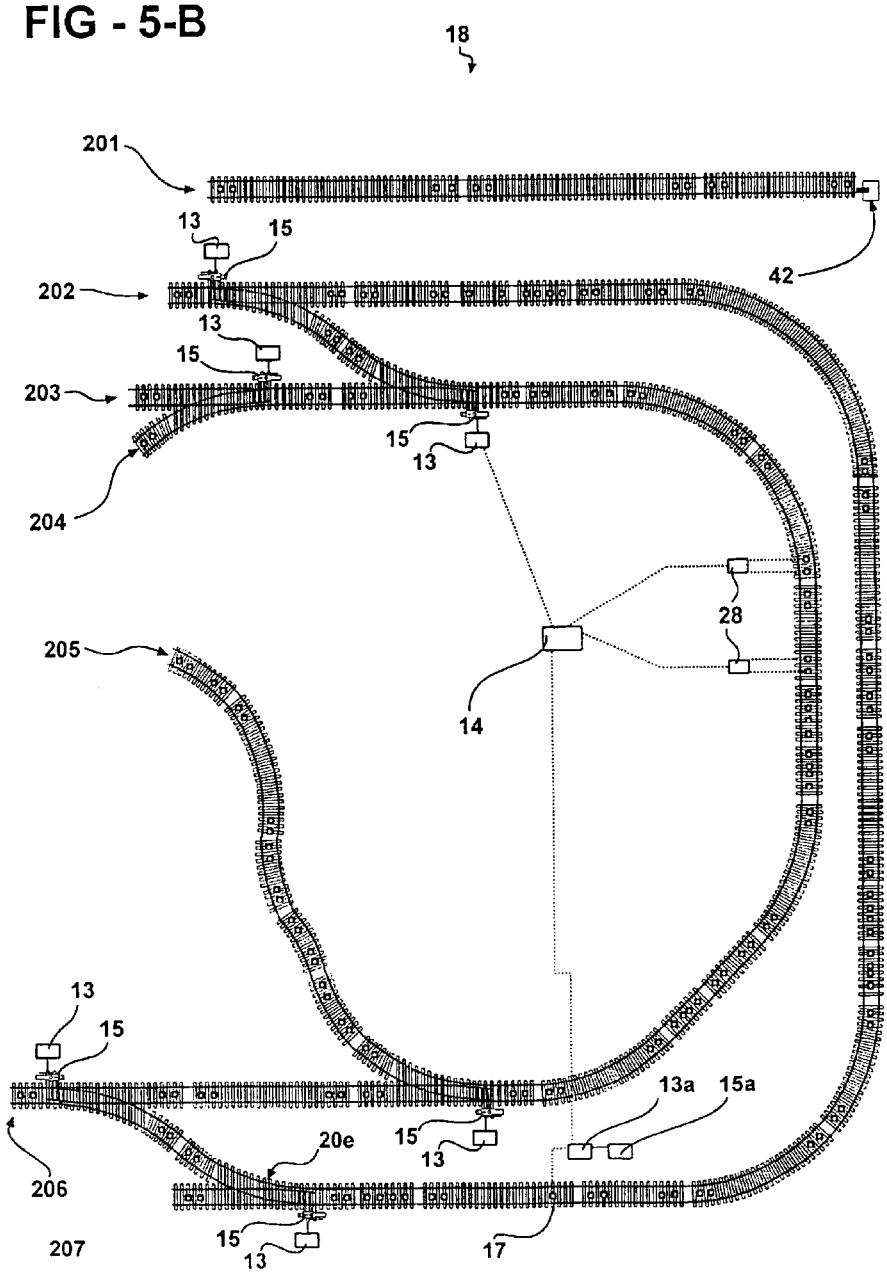

FIG - 13A
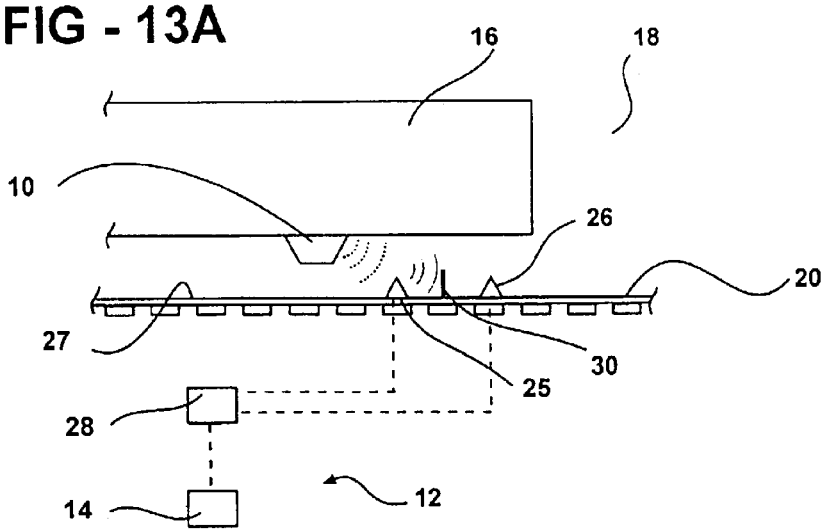
FIG - 13B
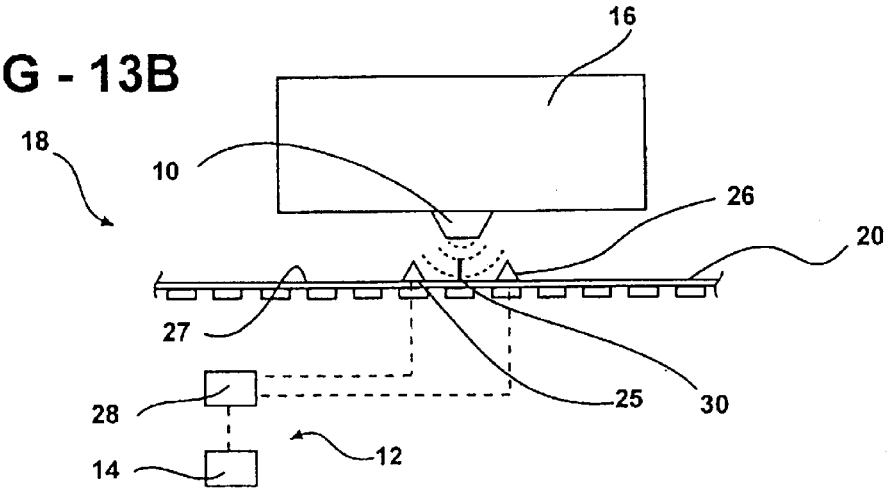
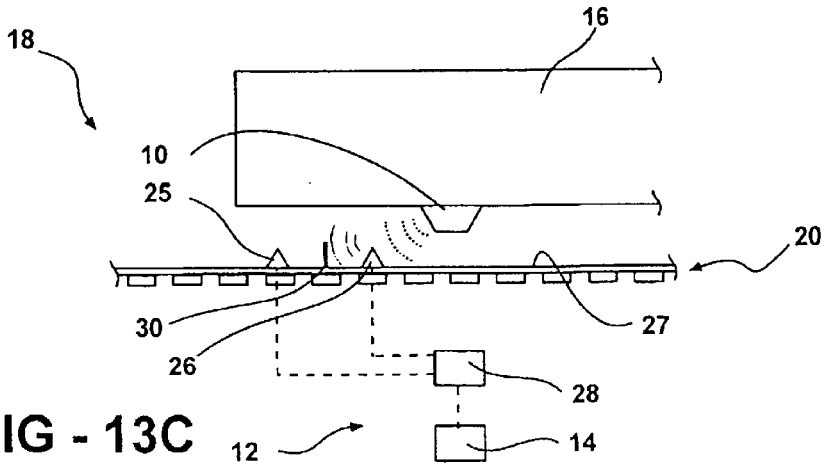
FIG - 13C

| 1 = Track<br>2 = Switch | Block ID | CC1 | CC2 | CW1 | CW2 | INDIRECT | Actuator ID |
|---|---|---|---|---|---|---|---|
| 1 | 2 | 1 | 0 | 3 | 4 | 0 | |
| 2 | 5 | 2 | 0 | 3 | 4 | 0 | 16312 |

| Block | CC | CW |
|---|---|---|
| 1 | | 2 |
| 2 | 1 | |
| 3 | | |
| 4 | | |

| Block | CC | CW |
|---|---|---|
| 1 | | 2 |
| 2 | 1 | 3 |
| 3 | 2 | |
| 4 | | |

| 1 = Track<br>2 = Switch<br>3 = Cross | Block ID | CC1 | CC2 | CW1 | CW2 | INDIRECT | Actuator ID |
|---|---|---|---|---|---|---|---|
| 1 | 2 | 1 | 0 | 3 | 0 | 5 | |
| 1 | 5 | 4 | 0 | 6 | 0 | 2 | |

```
1,1,54,55,61,60
1,2,58,57,3,0
2,3,2,0,23,0,17567
2,4,5,0,23,0,17536
1,5,7,6,4,0
2,6,8,0,5,0,16927
2,7,16,17,5,0,16896
1,8,10,9,6,0
2,9,13,0,8,0,17183
2,10,11,12,8,0,17152
2,11,14,0,10,0,17280
2,12,15,0,10,0,17311
1,13,61,0,9,0
1,14,0,0,11,0
1,15,0,0,12,0
2,16,20,0,7,0,17024
2,17,19,18,7,0,17055
2,18,21,0,17,0,17439
2,19,22,0,17,0,17408
1,20,0,0,16,0
1,21,0,0,18,0
1,22,0,0,19,0
1,23,4,3,24,25
2,24,23,0,52,0,17664
2,25,23,0,26,0,17695
1,26,25,0,27,0
1,27,26,0,28,29
2,28,27,0,30,0,17792
2,29,27,0,31,0,17823
1,30,28,0,50,49
1,31,29,0,32,0
2,32,31,0,41,0,18176
2,33,34,0,41,0,18207
1,34,35,0,33,0
2,35,37,0,34,0,18079
2,36,37,0,39,0,18048
2,37,52,0,36,35,18304
2,38,52,0,40,0,18335
1,39,36,0,0,0
1,40,38,0,0,0
1,41,32,33,42,0
2,42,41,0,53,0,18432
2,43,48,0,53,0,18463
2,44,53,0,46,0,18560
2,45,53,0,47,0,18591
1,46,44,0,47,0
1,47,46,0,45,0
1,48,49,0,43,0
2,49,30,0,48,0,17951
2,50,30,0,51,0,17920
1,51,50,0,54,0
1,52,24,0,37,38
1,53,42,43,44,45
2,54,51,0,1,0,16512
2,55,56,0,1,0,16543
1,56,57,0,55,0
2,57,2,0,56,0,16799
2,58,59,0,2,0,16768
1,59,60,0,58,0
2,60,1,0,59,0,16671
2,61,1,0,13,0,16640
```

FIG - 23

DYNAMIC SELF-TEACHING TRAIN TRACK LAYOUT LEARNING AND CONTROL SYSTEM

CROSS-REFERENCE TO RELATED APPLICATIONS

This application claims priority from Provisional Application No. 60/349,851, filed Jan. 17, 2002, entitled "Dynamic Self-Teaching Train Controller", which disclosure is incorporated herein by reference.

STATEMENT AS TO RIGHTS TO INVENTIONS MADE UNDER FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISK.

Not Applicable

BACKGROUND OF THE INVENTION

The present invention relates to model vehicles, in particular model trains, and more particularly to systems for locating trains and determining a track layout.

After model train tracks are put in place, trains can be run across them under a variety of control systems. In one system, the power to the track is increased, or decreased, to control the speed and direction of the train. Multiple trains can be controlled by providing different power levels to the different sections of the track having different trains (see, e.g., U.S. Pat. No. 5,638,522). In another system, a coded signal is sent along the track, and addressed to the desired train, giving it a speed and direction. The train itself controls its speed by converting the AC voltage on the track into the desired DC motor voltage for the train according to the received instructions. The instructions can also tell the train to turn on or off its lights, horns, etc. U.S. Pat. Nos. 5,749,547 and 5,638,522 issued to Neil Young et al. show such a system.

The arrival of a train on a section of track can be detected in some systems, such as by detecting the load on the current applied to the track, and can be used to activate certain elements connected to the track, such as a switch or a stoplight (see, e.g., U.S. Pat. No. 5,492,290).

U.S. Pat. No. 4,349,196 shows a system with a unique bar code on the bottom of each train car, with detectors mounted in the track below. This allows a determination of which car is over the sensor, and which cars have been assembled in a train. U.S. Pat. No. 5,678,789 shows a system with sensors in the track for detecting the position and velocity of a passing train.

U.S. Pat. No. 6,480,766 contains a discussion of different systems, including satellite Global Positioning Systems (GPS) for determining the location of a particular full sized (not model) train. U.S. Pat. No. 5,803,411 shows a train which detects position indicators along the side of a track, and provides these to an onboard computer for determining the position, speed, etc. of the train.

A system where a user can input commands to generate a graphical representation of a train track layout is shown, for example, in U.S. Pat. No. 6,460,467.

BRIEF SUMMARY OF THE INVENTION

The present invention provides a method and apparatus for determining a model vehicle layout by moving a vehicle around the track and noting when the vehicle passes track position detection elements. The vehicle can either detect the position detection elements, or the position detection elements can be sensors which detect the vehicle. By noting the order of the position detection elements as detected, and the direction of the vehicle, the layout of the track can be determined. The position detection elements do not need to provide a position, but merely have separate IDs so they can be matched to a block of the track.

In one embodiment, the position detection elements are sensors along the track which detect an emitted ID from the vehicle, and also detect the speed and direction of the vehicle. This information is then relayed to a control system. In another embodiment, the vehicle detects the position detection element, and relays this information, along with the train ID, speed and direction, to the control system. This second embodiment eliminates the need to connect sensors to the control system.

In another aspect of the invention, a particular type of vehicle at a particular location can be identified, without using an expensive GPS system. This is accomplished through transmission of a vehicle ID, which can be associated with characteristics of the vehicle, and the position detection element. The type of vehicle can be used to selectively operate accessories adjacent that portion of the track. For example, only trains with open top cars can activate a grain loading accessory along the track.

The invention also can provide automated route generation, the route between A and B meeting input route parameters (e.g., backing into destination) can be automatically determined. The determined route can then be displayed, or automatically selected by controlling engine speed and direction and switches.

Also, default accessory and switch selection can be automatically provided to a hand-held controller based on what the vehicle is approaching. This eliminates the need for a user to select the appropriate switch or accessory when the vehicle is approaching them. The system assumes the next accessory or switch in the direction the vehicle is heading is the one the user will want to control next, and associates that switch with a switch control, and that accessory with an accessory control.

Other applications of the present invention will become apparent to those skilled in the art when following the description of the best mode contemplated for practicing the invention this read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 1 is a side view of a model train car with a transmitter according to an embodiment of the present invention;

FIG. 2 is a schematic representation of a transmitter according to an embodiment of the present invention;

FIG. 3 is an isometric view of a track section with a receiver according to an embodiment of the present invention;

FIG. 4 is a schematic representation of a receiver according to an embodiment of the present invention;

FIGS. 5A and 5B illustrate a track layout according to an embodiment of the present invention;

FIGS. 13A–13C illustrate dynamic information exchange between the transmitter to the receiver according to an embodiment of the present invention;

FIG. 23 is a table illustrating a numerical representation of the layout of FIG. 22 in controller memory.

DETAILED DESCRIPTION OF THE INVENTION

Active Sensor Embodiment

Figure 6:
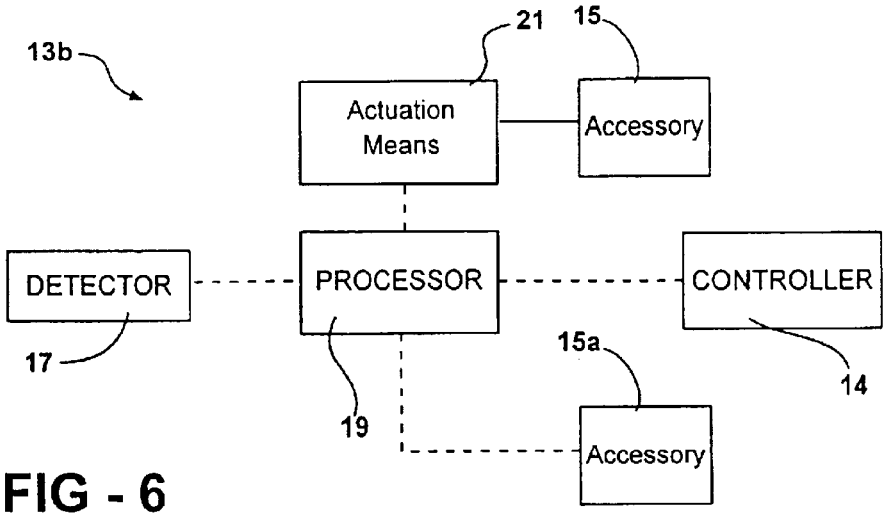
FIG. 6 is a schematic representation showing the receiver connected to the main control unit which in turn is used to operate accessories.

The present invention provides a method and apparatus for controlling one or more model trains moving along a path formed by several inter-connected sections of model train track. The invention includes a transmitter 10 connected to a model train car 16, at least one receiver 12 positionable along the path, and a controller 14. Transmitter 10 can transmit information associated with the car 16, such as car type and car number, to receiver 12. Receiver 12 can receive the information from the transmitter 10 and communicate the information to the controller 14 with a serial communication line. The controller 14 can receive information from receiver 12 and emit commands to the car 16 in accordance with a control program stored in memory.

Referring now to FIG. 1, transmitter 10 is operably engaged with car 16. Transmitter 10 is moved along the path 18 as the car 16 moves along the path 18 and can transmit information associated with car 16 to receiver 12 (shown in FIG. 2) when car 16 is in predetermined proximity with receiver 12. Transmitter 10 is engaged with car 16 on a surface 22 of the car 16 that opposes the path 18 so that transmitter 10 is directed towards the path 18. However, the transmitter 10 can be directed in any direction with respect to the path 18 so long as the receiver 12 is correspondingly positioned to receive the information. Car 16 can be an engine, a caboose, a cargo car or a passenger car.

Preferably, each car 16 moving along the path 18 includes a transmitter 10. However, the invention can be practiced wherein transmitters 10 are engaged only with model train engines. In another embodiment of the invention, transmitters 10 are engaged with the model train engines moving along the path 18 and less than all the other cars moving The transmitter 10 can be powered by the same power source that powers the car 16. If the car 16 is not an engine, the car 16 can be adapted to receive power from the same source that supplies power to model train engines moving along the path 18.

Referring now to FIG. 2, transmitter 10 can include a controller 44 and a light emitting diode 46. The controller 44 can control the light emitting diode 46 to emit infrared radiation pulses in a predetermined pattern. The predetermined pattern corresponds to information associated with the car. The predetermined pattern can be defined by the duration of individual infrared radiation pulses and the time period between pulses. Transmitter 10 can continuously repeat the predetermined pattern to enhance the likelihood that the information will be accurately received by the receiver 12.

In a preferred embodiment of the present invention, the transmitter 10 is a modulated infrared emitter, operable to emit infrared radiation having a wavelength in the range of 800 nanometers to 1000 nanometers. In a more preferred embodiment, the light emitting diode 46 emits infrared radiation in the range of 870 nanometers to 940 nanometers. Emitting infrared radiation within the range of 800 nanometers to 1000 nanometers enhances the rejection of visible light by the receiver 12. Visible light detracts from the quality of the information exchanged between the transmitter 10 and the receiver 12. A light emitting diode 46 is available for purchase from many manufacturers, including Lite On®, part number LTE-4206, and Toshiba®, part number TLN110. Preferably, the emission angle of the light emitting diode 46 is from 15° to 25° and the energy level is approximately 0.7 mW/cm2.

The controller 44 can be operably associated with the engine 43 of a model train car to determine the speed of the engine 43 as well as the hours of operation of the engine 43. The controller 44 can communicate this information to the receiver 12 by controlling the light emitting diode to emit a predetermined pattern of infrared radiation pulses. Also, the controller 44 can receive electromagnetic wave signals from the controller 14 or from another source and stop the engine 43 or reduce the speed of the engine 43 in response to the wave signals. With respect to other sources of wave signals, a human operator, for example, can cause wave signals to be directed to the controller 44 to slow or stop the engine 43.

The transmitter 10 can emit a plurality of different predetermined patterns of infrared radiation pulses corresponding to different information or can emit a single predetermined pattern. For example, a first predetermined pattern can correspond to a car number of the car. A second predetermined pattern can correspond to a car type, such as a caboose, engine, passenger car or cargo car. Furthermore, various categories of cars can be further defined to enhance the specificity of the information transmitted by the transmitter. For example, the transmitter can transmit a message to the receiver that indicates that the car 16 is a cargo car carrying the particular type of cargo. In an embodiment of the invention in which the controller 44 communicates with the engine 43, the information communicated can include the hours of operation of the engine 43 and/or the motor speed of the engine 43. In a preferred embodiment of the invention, the transmitter 10 can at least emit a first predetermined pattern of infrared radiation pulses corresponding to a car number of the car Referring now to FIG. 3, receiver 12 is positionable along the path 18, can receive information from a transmitter, and can communicate the information to the controller 14. Receiver 12 can receive information from the transmitter when the transmitter is in predetermined proximity with the receiver 12. Receiver 12 is engaged with a track section 20. Preferably, a pair of receivers 12 and 12*a* are positioned at opposite ends of each track section 20 and each receiver includes two detectors 25 and 26. However, the receiver 12 can include only one detector 25. The detectors 25 and 26 detect the predetermined pattern of infrared radiation pulses from the light emitting diode 46 of the transmitter 10 and communicate the predetermined pattern to a processor 28 of the receiver 12. An obstructing member 30 can be positioned between the detectors 25 and 26 to limit a range of reception of the detectors 25 and 26 with respect to each other. Also, the distance between the detectors 25 and 26 can be varied to control the range of reception of each detector 25 or 26 with respect to each other.

The detectors 25 and 26 are mountable on an upwardly facing surface 27 of the track section 20 to receive the information from the transmitter 10. However, the detectors 25 and 26 can be positioned adjacent a track section 20 if the transmitter does not transmit information toward the path 18.

Referring now to FIG. 4, receiver 12 can also include an amplifier 90 and a filter 92. The amplifier 90 can reduce errors caused by the reception of multiple signals at a single receiver 12. In particular, the gain of the amplifier 90 can be selected to control the range of reception. The amplifier 90 permits a predetermined range of reception for signal information recovery, but limits the predetermined range to exclude adjacent track sections. The filter 92 can reject ambient light pulses of the same wave length as the signal emitted by the transmitter 10. The receiver 12 can be tuned to the same wavelength as the transmitter to provide band pass filtering.

Processor 28 can receive signals from detectors 25 and 26 corresponding to the predetermined pattern of infrared radiation pulses transmitted by the transmitter 10. Processor 28 converts the signals received from the defectors 25 and 26 into a form of information usable by the controller 14 and communicates the information to the controller 14. In addition, the processor 28 can uniquely identify the receiver 12 to the controller 14 with respect to every other receiver or any other device communicating with the controller 14 positioned along the path. The processor 28 will identify the receiver 12 to the controller 14 each time information is communicated to the controller 14.

FIGS. 5A and 5B represent portions of a path 18 formed by the inter-connected sections of track 20. The portions of the path 18 shown in FIGS. 5A and 5B are connected at joints 201, 202, 203, 204, 205, 206 and 207.

Referring now to FIG. 5A, receivers 12 are positioned along the path 18. In order to enhance the clarity of FIG. 5; most of the receivers 12 are represented along the path 18 as simply detectors 25. However, it is to be recognized that each receiver 12 will also include a processor in communication with the detectors 25 and the controller 14. The present invention can be practiced wherein a section 20*a* of track has no receivers. However, the number of track sections 20*a* along the path 18 is preferably minimized. The path 18 can also include sections 20*b* that include one receiver 12. Also, relatively longer sections 20*c* of track can include more than two receivers 12. Specialized sections of track such as a x-shaped section 20*d* of track or a y-shaped section 20*e* of track can include four or three receivers 12*a,* respectively. In addition, a y-shaped section 20*f* of track can include only two receivers 12. The position and number of receivers 12 along the path 18 can be varied as needed.

Referring now to FIG. 5B receiver 12 can be positioned adjacent the end 42 of a branch of the path 18*a* wherein the distance between the receiver 12 and the end 42 is of sufficient length to permit the car 16 to stop before reaching the end 42.

The controller 14 can communicate with each of the receivers 12 positioned along the path 18. To enhance the clarity of FIG. 5B, the controller 14 is shown communicating only with two receivers 12. However, it is to be noted that the controller 14 will communicate with each receiver 12. The controller 14 can locate the position of the car 16 along the path 18 by communicating with the receivers 12.

The controller 14 can also communicate with actuators 13 positioned along the path 18. Actuators 13 can communicate information to the controller 14 and receive commands from the controller 14. For example, the present invention can be practiced with actuators that can move track switches between two positions, or with actuators that can activate a light emitting device such as crossing light or station light, or with actuators that can emit sounds such as crossing bells or a horn. The controller 14 can receive information from receivers 12 with respect to the location of a model train moving along the path and engage actuators to control the movement of the model train or activate accessories positioned along the track, adjacent to the model train or in advance of the model train, to enhance the realism of the model train system.

Actuator 13*a* includes at least one detector 17 positioned along the path 18. To enhance the clarity of FIG. 5, the controller 14 is shown communicating only with one actuator 13 and one actuator 13*a*. However, it is to be noted that the controller 14 can communicate with each actuator 13 and with each actuator 13*a*.

Referring now to FIG. 6, the actuator 13*b* can include a processor 19 that can receive information corresponding to a predetermined pattern of infrared radiation pulses detected by detector 17. Processor 19 can convert a signal received by the detector into a form of information usable by the controller 14. In addition, the processor 19 can uniquely identify the actuator 13*b* with respect to every other receiver and actuator positioned along the path. The processor 19 will identify the actuator 13*b* to the controller 14 each time information is communicated to the controller 14.

The processor 19 can also receive commands from the controller 14 to actuate a model train accessory. The accessory can be a moveable accessory 15 such as a track switch or can be an electrically engageable accessory 15*a* such as a light. The actuator 13*b* is shown engaging both a moveable accessory and an electrical accessory. The invention can also be practiced with an actuator engageable with only a moveable accessory or engageable only with an electrical accessory. The actuator 13*b* can include actuating means 21 for moving accessory 15. Actuating means 21 can be any electromechanical means for moving known in the art. For example, means 21 can be an electric motor, a linear screw mechanism or an electrically driven cam and cam follower mechanism.

Figure 7:
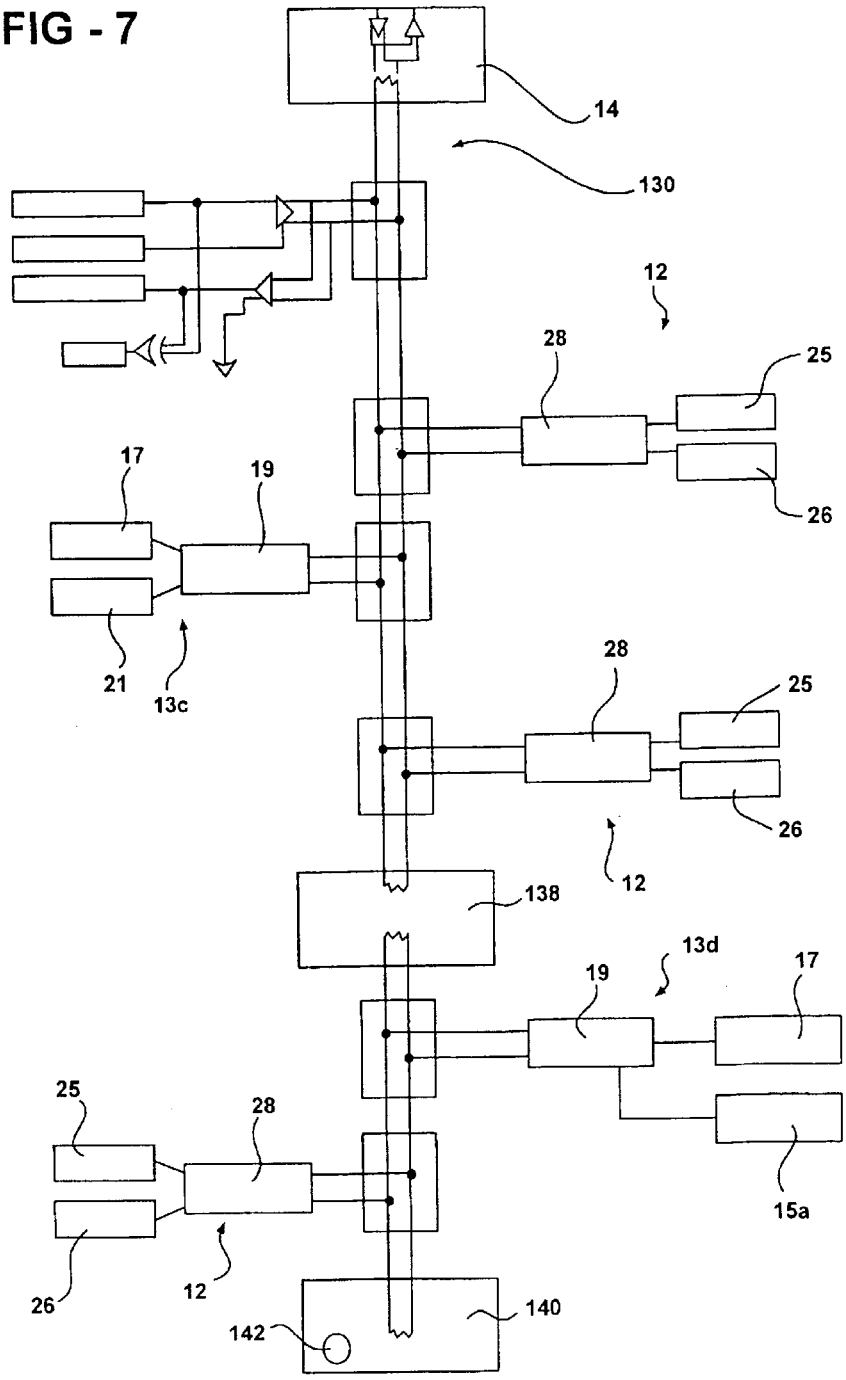
FIG. 7 is a schematic representation showing the communication line according to an embodiment of the present invention.

Referring now to FIG. 7, the controller 14 can communicate with actuators 13*c*, actuators 13*d* and receivers 12 with a serial communication line 130, such as an RS485 system. The line 130 can include a four wire interface having RJ11 phone connection having five volt power and ground power return. Bit transmission speed can be 100 kilobytes per second and 10 microseconds per bit at a minimum. The system can be operable to transmit at 250 kilobytes per second and 2.5 microseconds per bit. The system communicates in an asynchronous format with eight data bytes per character and a ninth bit used as the beginning of a message marker. Each transmission includes eleven bits. The software used for managing the system can have a byte transmission speed of 9.09 K bytes/sec and 110 $\mu$sec/byte. In one embodiment, the system will have a byte transmission speed of 22.7 K bytes/sec and 44 $\mu$sec/byte. Other speeds and formats can be used, the above is simply an example.

The system can also include a booster or amplifier 138 to amplify signals carried by the line 130 and prevent degradation of the signals. The system can also include a termination module 140 having an light emitting diode 142. The termination module 140 can verify the stability of the system with the light emitting diode 142. For example, if the system fails, the light emitting diode 142 can be disengaged.

The present invention also provides a communication system for controlling one or more model trains moving along a path formed by several inter-connected sections of model train track. Controlling the movement of at least one model train moving along the path in enhanced by the accurate transmission of information. Information communicated by the communication system includes information corresponding to each model train car moving along the path as well as information corresponding to commands emitted by the controller to control the movement of each model train car and to control accessories. The communication system of the present invention enhances the accuracy of the information received by the controller as well as the accuracy of commands received by actuators positioned along the path.

Information corresponding to the model train car moving along the path is transmitted from the model train car by the transmitter and is received by the receiver. The information corresponding to a model train car that can be transmitted includes car number, car type, engine speed of model train engine and operating hours of a model train engine. Preferably, each train car moving along the path is assigned a different car number than every other train car moving along the path. However, two train cars moving along the path can have the same car number if the two cars can be distinguished from each other as being different car types. The information corresponding to the model train car can be stored in memory of the transmitter in four bit format.

Figure 8:
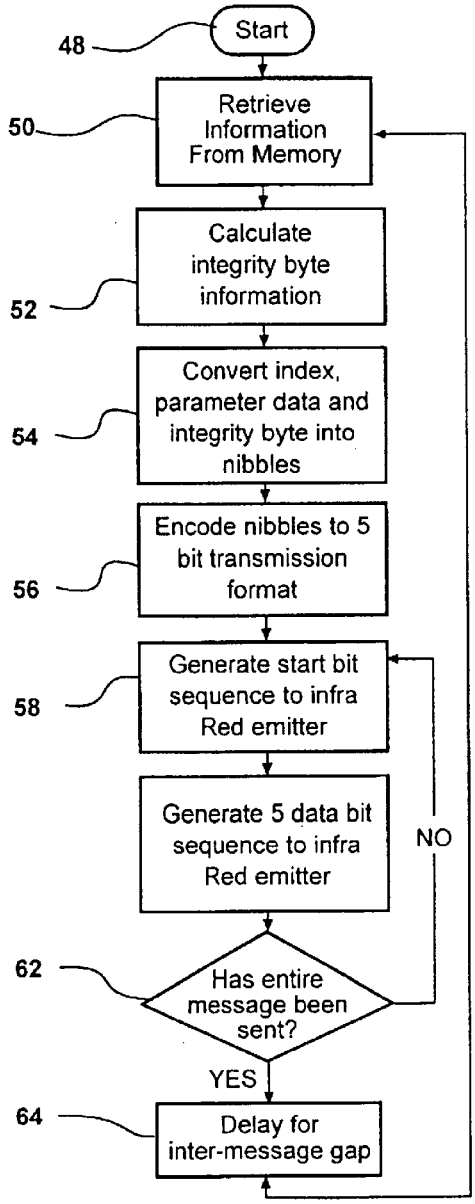
FIG. 8 is a flow chart detailing the steps for transmitting a message by a transmitter according to an embodiment of the invention.

Referring to FIG. 8, a simplified flow diagram illustrating the steps for transmitting information by the transmitter is provided. The process starts at step 48. At step 50, the information to be transmitted is retrieved from memory. The information includes at least two components: index data and parameter data. Index data corresponds to a genus of information and parameter data corresponds to a species of information within the genus. For example, the index data can correspond to the genus model train engines and the parameter data can correspond to a particular model train engine. In a preferred embodiment of the present invention, index values are assigned according to the table provided immediately below:

| Index Value | Parameter Data |
|---|---|
| 0 | Car Number |
| 1 | Car Type |
| 2 | Engine Speed MSB |
| 3 | Engine Speed LSB |
| 4 | Operating Hours MSB |
| 5 | Operating Hours LSB |

At step 52, the index data and parameter data are used to calculate an integrity byte. The integrity byte will be transmitted by the transmitter with the index data and parameter data. After receiving the information from the transmitter, the receiver can compare the integrity byte to the index data and the parameter data to verify the accuracy the index data and the parameter data. If the integrity byte is not consistent with respect to the index data and the parameter data, the receiver can reject the information received from the transmitter as erroneous. The method for calculating the integrity byte will be described in greater detail below.

At step 54, the index data, parameter data and the integrity byte are converted into nibbles. As used herein, a nibble is a quantity of data having four bits.

At step 56, each nibble is converted from a four bit format to a five bit format. The nibbles are encoded from four bit to five bit data by the transmitter and decoded from five bit data to four bit data by the receiver. Encoding the information enhances the accuracy of information transmitted by the transmitter and received by the receiver. In particular, four to five bit encoding doubles the number of bit combinations and enhances the detection of invalid transmissions by the receiver because half of the total number of combinations are known to be invalid. The present invention can be practiced with encryption that encodes the four bit data into any number of bits greater than five, such as "four to six" bit encoding.

After the completion of steps 50 through 56, the transmitter can begin to transmit information to be received by the receiver. The information will be transmitted as a message including the index data, parameter data and the integrity byte. The transmitter can be operable to transmit more than one message. Each message will be transmitted as a predetermined pattern of infrared radiation pulses. Acceptance of the message by the receiver for communication to the controller is determined by comparing the pattern of pulses to a communication protocol. The communication protocol defines a plurality of successive time periods during which infrared radiation pulses must be received by the receiver. If the pulses are not received by the receiver according to the time periods defined by the communication protocol, the information is rejected by the receiver and not communicated to the controller. The communication protocol will be discussed in greater detail below.

The steps for transmitting information by the transmitter continues at step 58 and the light emitting diode generates infrared radiation pulses corresponding to the information to be transmitted. Step 62 monitors whether the entire message has been sent. If not, the process returns to step 58 and the additional information is transmitted. If the information has been fully transmitted, the process continues to step 64 and is delayed according to the communication protocol. The delay lasts more than 150 microseconds. After the delay, the process returns to step 50.

Figure 9:
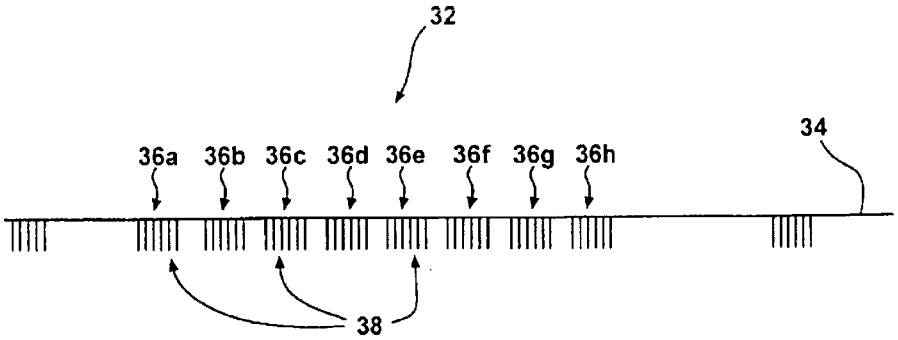
FIG. 9 is a schematic representation of a message exchanged between a transmitter to a receiver according to an embodiment of the present invention.

Referring now to FIG. 9, a sample message 32 conforming to the communication protocol of a preferred embodiment of the invention is illustrated. Horizontal line 34 is a schematic representation of time. The predetermined pattern of message 32 is defined by bits 38, representing an operational state of the light emitting diode of the transmitter, and can be divided into eight distinct bursts 36*a*–36*h* of data. Each burst of data can be divided into six bits 38 of data.

Figure 10:
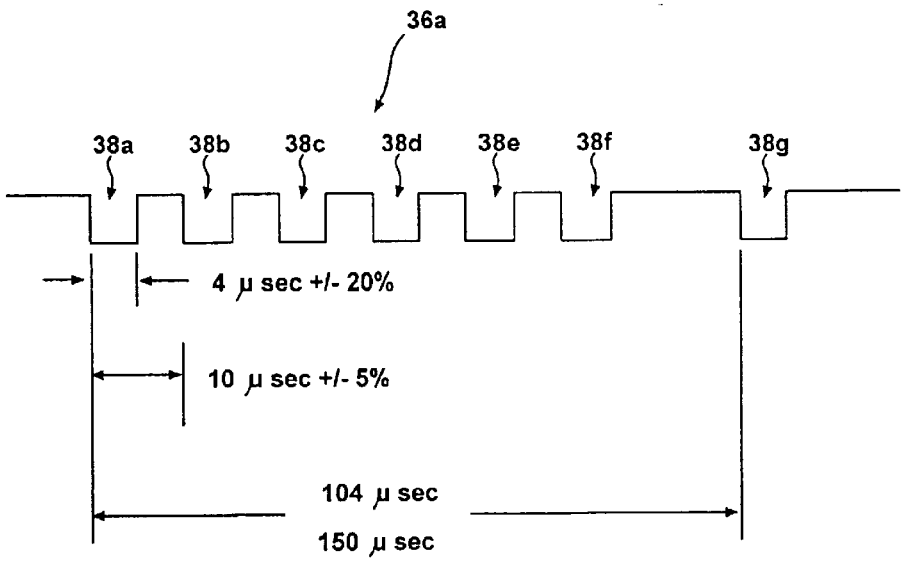
FIG. 10 is a schematic representation of a burst communicated as part of a message according to an embodiment of the present invention.

Referring now to FIG. 10, each bit 38*a*–38*h* represents an operational state of the light emitting diode during a particular time period. The light emitting diode can be on or off and the receiver can assign a value to each bit 38*a*–38*h* based on the operational state. For example, if the light-emitting diode is emitting infrared radiation during the period of the second bit 38*b*, bit 38*b* can be assigned a value of 0 by the receiver. Conversely, if the light-emitting diode is not emitting infrared radiation during the period of the second bit 38*b*, bit 38*b* can be assigned a value of 1 by the receiver. Bits 38*a*–38*f* are schematic representations and can have a value of 1 or 0. Each bit 38 preferably lasts 4 microseconds, +/−20%.

The first bit 38*a*, or start bit, of the first burst 36*a* initiates the exchange information between the transmitter and the receiver. Preferably, the start bit 38*a* will always be 0, representing that the light-emitting diode is on. The start bit can be assigned a value of 0 to synchronize the timing sequence of data transmission. If the start bit 38*a* were not assigned a value of 0, the receiver could not verify when a second burst begins after a first burst has ended.

The five bits 38*b*–38*f* of burst 36*a* correspond to the nibble of the data. The five data bits 38*b*–38*f* can correspond to index data, or parameter data, or the integrity byte.

The time period lasting from the beginning of a first bit 38*a* to the beginning of a second bit 38*b* is preferably 10 microseconds, +/−5%. The time period lasting from the beginning of the last bit 38*f* of a first burst 36*i* to the beginning of a first bit 38*g* of a second burst is between 104 microseconds to 150 microseconds. The time period lasting between the beginning of the last bit of the last burst of a first message to the first bit of the first burst of a second message is greater than 150 microseconds. In a preferred embodiment of the present invention, the receiver recognizes the beginning of a new message if the period of time between the start of the bit 38*a* to the start of the bit 38*g* is greater than 150 microseconds.

Each burst must contain at least two bits assigned a value of 0, in addition to the start bit. A burst received by a receiver that does not include two or three bits having an assigned value of 0 will be considered invalid by the receiver and will not be communicated to the controller. Furthermore, if one burst of a particular message is rejected, the entire message is rejected. It has been recognized that by requiring each burst to include at least two bits having an assigned a value of 0 increases the likelihood that the information to be transmitted will be accurately transmitted to the receiver. It is assumed that by requiring at least two bits assigned a value of 0 tends to enhance the rejection of bursts corrupted by natural light, electrical noise or other infrared sources.

In a preferred embodiment of the invention, data is communicated according to the burst pattern provided immediately below:

| Burst Value | Hex Data Value |
|---|---|
| 001011 | 0 |
| 010011 | 1 |
| 010100 | 2 |
| 001001 | 3 |
| 010110 | 4 |
| 000101 | 5 |
| 001110 | 6 |
| 010010 | 7 |
| 001010 | 8 |
| 000110 | 9 |
| 011010 | A |
| 001100 | B |
| 001101 | C |
| 010101 | D |
| 011001 | E |
| 010001 | F |

Each burst can be asynchronous with respect to the preceding burst. The time periods between successive bursts are selected to enhance the likelihood of successful data transmission. Specifically the time periods associated with each component of a message 32 are minimized to enhance the likelihood that a message 32 can be transmitted several times while the transmitter is in predetermined proximity with respect to the receiver even if the car 16 is traveling at its most velocity.

Referring now to FIG. 9, the first two bursts, 36*a* and 36*b*, of the message 32 correspond to index data. The third through six bursts, 36*c* through 36*f*, correspond to parameter data. The seventh and eighth bursts, 36*g* and 36*h*, correspond to the correction byte. After burst 36*h* is an inter-message gap to separate the messages.

The index data included as the first two bursts 36*a* and 36*b* of the message 32 identifies the category of the parameter data to be transmitted in the succeeding bursts 36*c* through 36*f*. The index is made up of one byte of data and can contain up to 256 locations. Preferably, a value of 0 is assigned to the index representing the highest priority data being transmitted by the transmitter 10.

The parameter data is data particular to the corresponding car 16 and corresponds to the index data of a particular message can be 0, corresponding to a car number, and the associated parameter data can be, by way of example and not limitation, 25. The message communicated to the controller by the receiver would advise the controller that train car number 25 is in predetermined proximity to the receiver. Parameter data and index data can be preprogrammed with respect to the transmitter. The parameter data for a particular message is made up of two bytes of information. Preferably, the parameter data communicated by the transmitter to the receiver will at least include the number of the car.

Bursts 36*g* and 36*h* correspond to the integrity byte (the correction or check byte). The integrity byte enhances the likelihood of successful transmission of the message 32 between the transmitter and the receiver. In particular, the integrity byte corresponds to the parameter data (rotated and exclusive-ORed) and is compared to the parameter data by the receiver (after reversing the exclusive-OR and shifting). If the integrity byte and the parameter data do not correspond, the message 32 is rejected as erroneous.

Figure 11A:
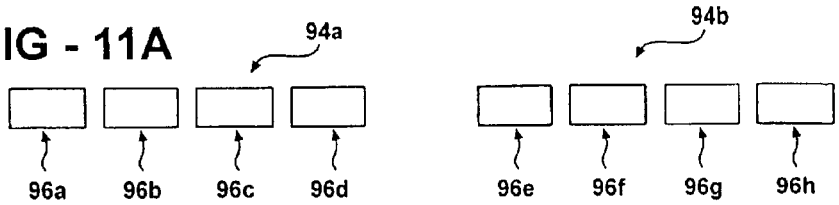
FIGS. 11A–F are schematic representations of the construction of an integrity byte according to an embodiment of the present invention.
Figure 11B:
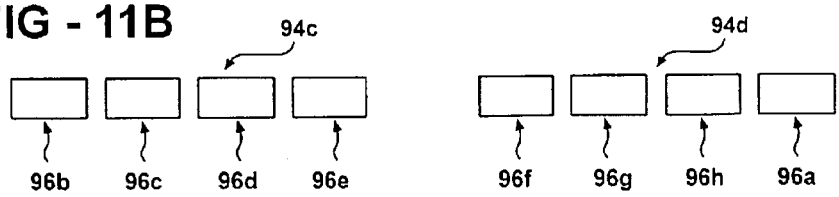
Figure 11C:
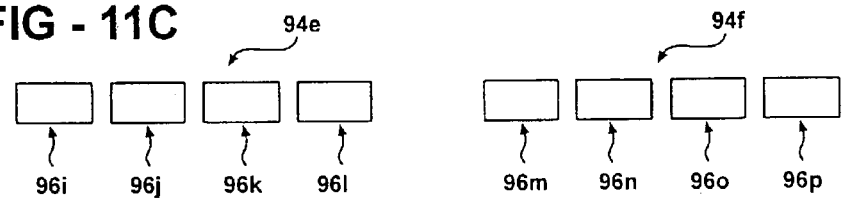
Figure 11D:
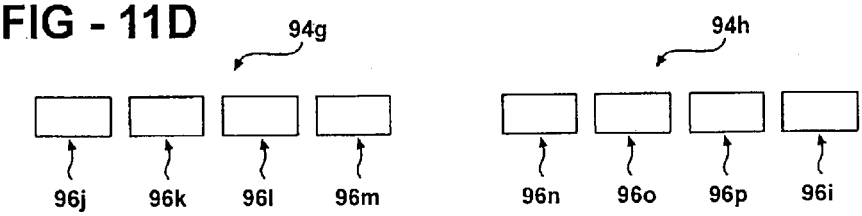
Figure 11E:
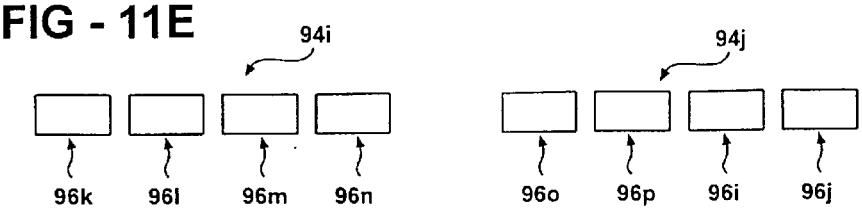
Figure 11F:
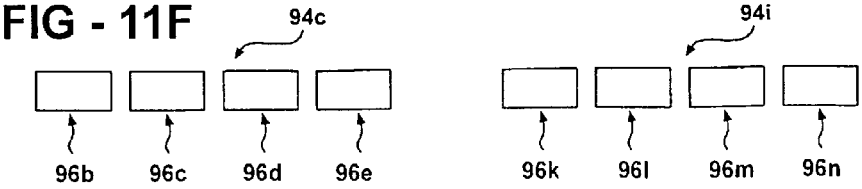

FIGS. 11A–F illustrate the construction of the integrity byte. The integrity byte includes two bursts and is made up of one byte of information. Nibbles 94*a* and 94*b* correspond to one byte of parameter data. The nibbles 94*a* and 94*b* can be converted to five bit format and transmitted as bursts 36*c* and 36*d* shown in FIG. 9. The bursts 36*c* and 36*d* represent the "MSB" parameter data. The term MSB refers to the most significant byte. Each nibble contains four fields of data, nibble 94*a* having fields 96*a* through 96*d*. The first nibble 94*c* of the integrity byte is constructed by shifting the fields 96*a* through 96*h* of the nibbles 94*a* and 94*b* as shown in FIG. 11B. Each field 96*a* through 96*h* has been shifted to the left. The shifted fields are then exclusive-ORed with the unshifted fields to give the first nibble of the integrity byte. FIG. 11F shows that the first nibble of the integrity byte is nibble 94*c*.

The second nibble of the integrity byte corresponds to the fifth and sixth bursts, 36*e* and 36*f* respectively, of the message 32. FIG. 11C shows the nibbles 94*e* and 94*f* corresponding to the fifth and sixth bursts 36*e* and 36*f* of the message 32 of FIG. 9. The bursts 36*e* and 36*f* represent the "LSB" parameter data. The term LSB refers to the least significant byte. The fields 96*i* through 96*p* of the nibbles 94*e* and 94*f* are shifted twice, and exclusive-ORed with the unshifted original fields and the once shifted intermediate field to give the integrity nibble. In FIG. 11D, the fields 96*i* through 96*p* are shown shifted once to the left. In FIG. 11E, the fields 96*i* through 96*p* are shown shifted twice to the left with respect to the original position of the fields 96*i* through 96*p*. The fields in 11D and 11E are exclusive ORed with the original fields to construct the integrity byte. FIG. 11F shows the construction byte, unencrypted, having nibbles 94*c* and 94*i*. Other methods of constructing a check byte could alternately be used.

The integrity byte is constructed by the transmitter 10 prior to the encryption of the four bit index data and four bit parameter data to a five bit format. The integrity byte is also encoded from a four bit format to a five bit format.

As noted above, each transmitter is operable to emit a plurality of different signals, each signal corresponding to a different message. Also, the transmitter can continuously repeat each message or continuously repeat a series of different messages. In a preferred embodiment of the present invention, a message corresponding to an index having a value of 0 is repeated every other message. For example, if an index value of 0 corresponds to the car number, the message communicating the car number is repeated every other message. The transmitter 10 can transmit a first message corresponding to a car number, then transmit a second message corresponding to a car type, and then transmit a third message identical to the first message corresponding to the car number. By repeating the index 0 message, the highest priority data is transmitted more often to increase the likelihood of a successful transmission.

Figure 12:
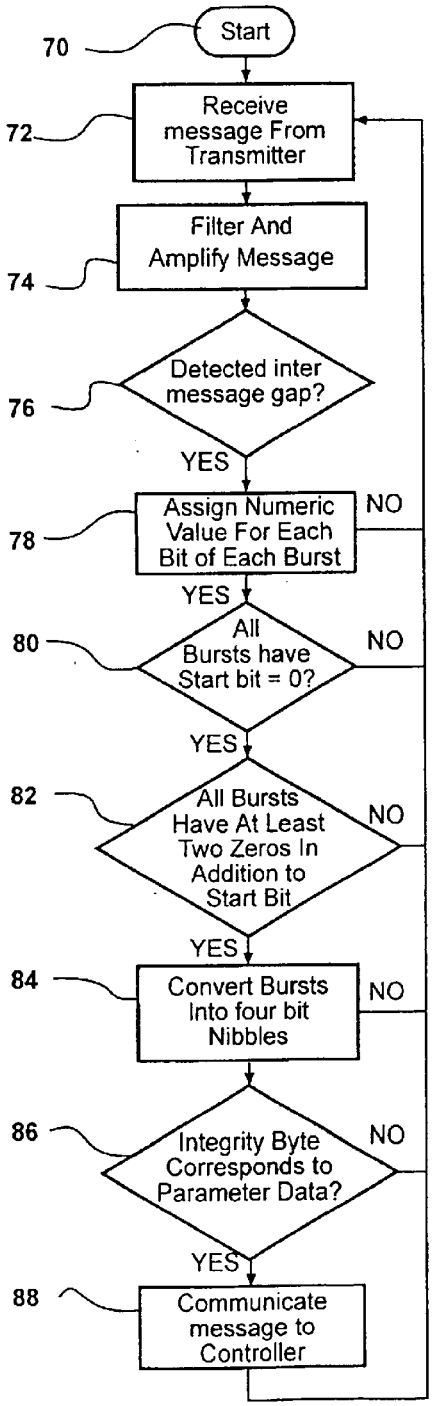
FIG. 12 is a flow chart detailing the steps for receiving a message by the receiver according to an embodiment of the present invention.

Referring to FIG. 12, the process steps for receiving the predetermined pattern of infrared radiation pulses by the receiver according to an embodiment of the present invention are shown. The process starts at step 70. The message is received from the transmitter at step 72. The message, in the form of a predetermined pattern of infrared radiation pulses, can be filtered by a high frequency by-pass filter and amplified at step 74. Step 76 rejects the message if the inter-message gap has not been detected. The gap is greater than 150 microseconds. If the gap is detected, the process continues and step 78 assigns a numeric value to each bit of each burst. Each bit can be assigned a value of 1 or 0 to correspond to an operational state of the light emitting diode.

Step 80 confirms that all bursts include a start bit having an assigned value of 0, corresponding to the light emitting diode being on. If any of the bursts do not have a start bit assigned a value of zero, the process returns to step 72 and the message is not communicated to the controller 14.

Step 82 confirms that all bursts include at least two bits in addition to the start bit having and assigned value of 0, corresponding to the light emitting diode being on. If any of the bursts do not have at least two bits in addition to the start bit having an assigned value of zero, the process returns to step 72 and the message is not communicated to the controller 14.

Step 84 converts the five data bits of each burst into four bit nibbles. Step 86 compares the integrity byte to the parameter data. The comparison of integrity byte to the parameter data can correspond to a comparison of the bits of integrity byte with the bits of the MSB data and LSB data. If the integrity byte does not correspond to the parameter data, the process returns to step 72 and the message is not communicated to the controller 14. If the integrity byte does correspond to the parameter data, the message is communicated to the controller 14 at step 88 and the process returns to step 72.

Passive Sensor Embodiment

In another embodiment of the invention, the train detects the sensors along the track, rather than the other way around. The sensors can in fact be passive, such as a bar code or other marker that can be read. In one embodiment, the sensors constantly transmit a digital pattern corresponding to their ID, similar to the infrared transmission discussed above. A receiver on the train detects this, and then forwards it, along with the train ID, the train velocity and train direction, to the master controller.

The train can determine its own velocity from the rotation of its wheels and can determine its own direction from whether positive or negative voltage is applied to its motor, for example.

This embodiment eliminates the need for multiple sensors to be connected to the controller, either by wires or wirelessly, to provide the desired position information. Instead, the train can itself transmit the information, either wirelessly or through the wheels and train track to the central controller. Each sensor, or position indicator, can be then assigned a number as the train detects them, with the controller determining which ones are next to each other as the train passes them. In one embodiment, each sensor transmits a unique ID.

Determination of Speed and Direction

Referring now to FIGS. 13A–13C, the transmitter and receiver can also exchange information corresponding to the speed and direction of the model train. In FIGS. 13A through 13C, a car 16 is schematically shown passing over a receiver 12. The wheels of the car 16 engaging the section 20 of track of the path 18 are not shown. Detectors 25 and 26 are mounted on an upwardly facing surface 27 of the section 20. In FIG. 13A, the detector 25 receives the signal from the transmitter 10 before the detector 26. The obstructing member 30 prevents the detector 26 from receiving the signal 10 simultaneously with respect to the detector 25. Receipt of the signal by the detector 25 is communicated to the processor 28 of the receiver 12. The processor 28 can communicate to the controller 14 that the car 16 is in proximity to the detector 25.

In FIG. 13B, the signal is received by both detectors 25*a* and 26*a*. The processor 28 can communicate to the controller 14 the proximity of the car 16 to both the detectors 25 and 26. In FIG. 13C, only the detector 26 receives the signal from the transmitter 10. The processor 28 can communicate the proximity of the car 16, with respect to only the detector 26, to the controller 14. The controller 14 can be programmed to determine the velocity of the car 16 based on the configuration of the receiver 12, specifically the distance between detectors 25 and 26 and the difference, as measured in time, between the receipt of the signal by the detector 25 and the receipt of the signal by the detector 26. The controller 14 can determine the direction of movement of the car 16 based on the sequence of receipt of the signal with respect to detectors 25 and 26.

The present invention can also be practiced wherein the processor 28 is programmed to determine the speed and direction of the car 16. The logic steps performed by the processor 28 in computing the speed and direction of the car 16 would be identical to the logic steps performed by the controller 14 described above. In such an embodiment of the present invention, the controller 14 would receive the velocity and direction of movement of the car 16 from the processor 28.

In an alternate embodiment, the speed and direction of the engine are determined in the engine itself, by monitoring the commanded motor rotation direction and speed. The speed can also be detected by a rotational encoder.

As discussed above, the actuators and receivers positioned along the path can communicate with the controller along a serial communication line according to a communication protocol. The controller can receive messages from the receivers and the actuators the actuators can receive commands from the controller.

In each message communicated to the controller from one of the receivers and actuators, the first two bytes of the transmission supply identification information to the controller that identifies the source of the message. These first two bytes of information include sixteen bits. The first five bits contain class information corresponding to the receiver or actuator and the last eleven bits supply address information relating uniquely to an individual receiver or actuator. Actuators and receivers can be defined in different classes. Each class type will preferably include a minimum of 2,048 receiver or actuator addresses. Each receiver or actuator is preferably preprogrammed with address information. However, the invention can be practiced wherein the model railroader can modify the address information of a particular receiver or actuator. However, no two receivers or actuators within the network can have the same address. Subclasses can be created by using the upper address bit to identify different subclasses. This permits a possible 65,000 receiver or actuators on the network at one time without having to divide the network for expansion.

Figure 15A:
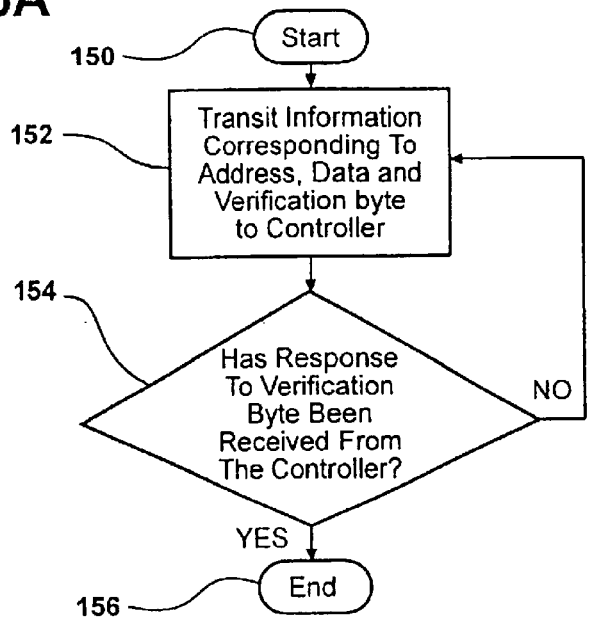
FIG. 15A is a flow chart detailing the steps for transmitting information to the controller by a receiver or actuator according to an embodiment of the invention.

The invention will preferably include means for verifying receipt of a communication between the controller and a receiver as well as a communication between the controller and each actuator. In a preferred embodiment of the invention, the process steps for communicating information from a receiver or actuator to the controller are shown in FIG. 15A. The process starts at step 150. At step 152 information corresponding to the address of the receiver or actuator, data received from the transmitter and a verification byte is transmitted to the controller. Step 154 determines whether a response to the verification byte has been received from the controller. If a response to the verification byte has not been received from the controller, the process returns to step 152 and the information is transmitted to the controller. If the response to the verification byte has been received from the controller, the process ends at step 156.

Figure 15B:
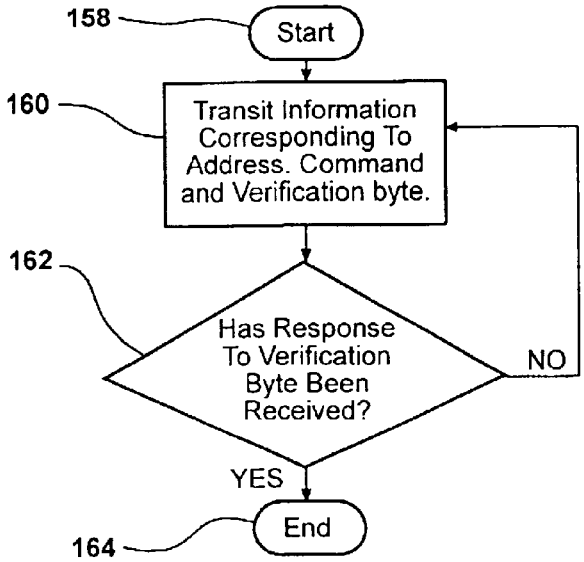
FIG. 15B is a flow chart detailing the steps for transmitting a command to a receiver or actuator by the controller according to an embodiment of the present invention.

The process steps in a preferred embodiment of the invention for transmitting a command to a receiver or actuator from the controller are shown in FIG. 15B. The process starts at step 158. At step 160, information corresponding to the receiver or actuator's address, a command and a verification byte is transmitted to the particular receiver or particular actuator by the controller. Step 162 monitors whether a response to the verification byte has been received from the receiver or actuator. If a response to the verification byte has not been received, the process continues to step 160 and the information is transmitted to the controller. If a response to the verification byte has been received from the receiver or actuator, the process ends at step 164.

Automatic Layout Determination

The present invention also provides an apparatus and method for configuring a control system for a model railroad. Existing control systems require the model railroader to build the track layout and then program a controller using a particular programming language. The present invention provides a model train having a transmitter for transmitting information corresponding to the model train, sections of track for defining a path; receivers and/or actuators positioned along the path to receive information from the model train when the transmitter is in predetermined proximity to an individual receiver or actuator and to communicate the information to a controller; and a controller to control the movement of the model train. The model train can move along the path and transmit a signal to individual receivers and actuators positioned along the path. The signal can correspond to information associated with the train or can be a predetermined initialization signal. An individual receiver or actuator can communicate the signal to the controller with address information unique to the individual receiver or actuator. The controller receives the signal and the information from the individual receivers or actuators and can locate the position of the model train with respect to the path and with respect to each receiver and each actuator. During initial configuration of the system, the controller can store in memory the position of each receiver and actuator with respect to every other receiver and actuator.

At startup, each sensor is placed in learn mode. In this mode, the sensor is assigned to the next sequential address to be used. This eliminates the need for the user to program each sensor on the layout.

During configuration of a control system according to a preferred embodiment of the invention, a car 16 can be moved along every portion of the path 18, coming into predetermined proximity with each receiver 12 and each actuator 13 positioned along the path 18. A unique address can be assigned to the receiver upon each encounter during the learn mode. Referring now to FIG. 5A, car 16 can come into proximity with the first receiver 112. The receiver 112 can communicate to the controller 14 (shown in FIG. 5B) that the car 16 is in predetermined proximity with receiver 112. The car 16 can then come into proximity with a second receiver 212 positioned along the path 18. The receiver 212 can communicate to the controller 14 that the car 16 is in predetermined proximity with the receiver 212. The sequence of the communications from the receivers 112 and 212 can be stored in the memory of the controller such that the controller 14 will recognize that the receivers 112 and 212 are positioned along the path 18 adjacent to each other. The car 16 can come into proximity with the third receiver 312. The receiver 312 can communicate to the controller 14 that the car 16 is in predetermined proximity with the receiver 312. The sequence of communications from the receivers 112, 212 and 312 can be stored in the memory of the controller 14 such that the controller 14 will issue control commands based, at least in part, on the positions of the receivers 112, 212 and 312 along the path 18 with respect to one another. Specifically, the controller 14 will recognize that the receiver 312 is positioned along the path adjacent to the receiver 212.

An individual receiver 12 or actuator 13 can be adjacent to one other receiver 12 or actuator 13 or more than one receiver 12 or actuator 13. The controller 14 can be operable to recognize the position of every receiver 12 or actuator 13 with respect to every other receiver 12 or actuator 13.

The transmitter 10 of the car 16 can be operable to transmit a command. For example, the signal transmitted to the receivers 12 and actuators 13 can be a command for the controller to store in memory the associated address location. The receiver or actuator will communicate the command to the controller along with the receiver's or actuator's address information. The controller 14 can respond to the command by storing the address information. The controller 14 can store in memory the address information of receivers 12 and actuators 13 as long as the car 16 moves along the path 18.

The controller 14 can be operable to store in memory address locations at predetermined times (the learn mode). There are a number of ways to determine when the learn mode is completed. For example, the controller 14 can be programmed to store address locations when initially engaged. As the controller 14 receives communications from the receivers 12 and actuators 13, the controller 14 can store the address information of each receiver 12 and actuator 14. The controller 14 can be programmed to stop storing address information after a predetermined number of addresses have been stored twice. Alternatively, the controller 14 can be programmed to stop storing addresses after predetermined period of time has elapsed. Alternatively, the controller 14 can be programmable to store address information continuously.

The controller 14 can also be programmable to update memory with respect to address information. For example, the controller 14 can cease storing address information after the controller 14 has stored in memory the address information of every receiver 12 and actuator 13 positioned along the path 18. After the controller 14 has operated for a predetermined period of time, the controller 14 can store address information again to enhance likelihood that the most accurate address information is stored in memory.

Table Building

Figures 16, 17, 18, 19:
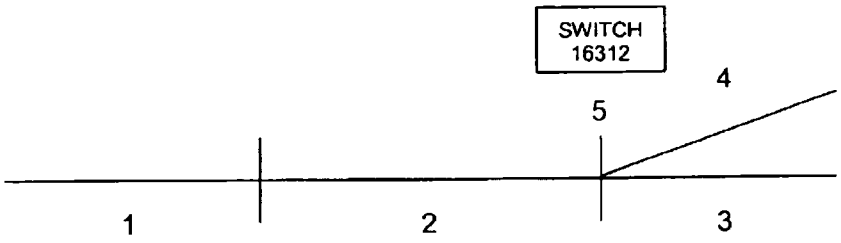
FIG. 16 is a diagram illustrating blocks and a switch for a portion of a track layout in a simple embodiment of the invention.
FIG. 17 is a table illustrating the representation of the blocks of FIG. 16 in a controller memory.
FIGS. 18 and 19 are diagrams illustrating the building of a table in memory to indicate block interconnections.

FIGS. 16 and 17 are illustrations of a simple example of how a table can be constructed in the train controller memory to determine the track layout. Shown in FIG. 16 is a portion of a track showing blocks 1, 2, 3 and 4, with a switch 5 switching between tracks 3 and 4. Switch 5 has an ID number 16312.

FIG. 17 illustrates a table which can be constructed in memory. The first column has either a 1, indicating it is a track section (a block), or a 2 indicating a switch. A third alternative is a 3 for a crossover, discussed below.

The next column sets forth the block ID. In the first row, block 2 is shown here. The next two columns show the counterclockwise 1 (CC1) and counterclockwise 2 (CC2) blocks. In a counterclockwise direction, there is only block 1, so there is a 1 in this column, while the second counterclockwise option has a 0 (a 0 indicates an empty connection). In the clockwise (CW) direction there is one possibility for block 5 (the switch), indicated for CW1 and CW2. Finally, an indirect column is used to indicate a non-switch intersection, which there is none here. The last column indicates the actuator ID, which does not apply to block 2.

The next row, begins with the number 2 to indicate a switch. This corresponds to switch 5, as indicated in the block ID section. Here, in the counterclockwise direction there is block 2, and a 0 (indicating no connection) for the second counterclockwise direction. In the clockwise direction, there are blocks 3 and 4, similarly to block 2. In the last column, the actuator ID is set forth.

FIGS. 18 and 19 illustrate how the table can be built. In FIG. 18, a train passing from block 1 to block 2 can detect sensors (or the sensors can detect it) at each of the blocks. When it passes from block 1 to block 2, the first entry for block 1 indicates in the clockwise direction that the next block is 2. Similarly, for block 2, since the train passed from 1 to 2, it knows that in the counterclockwise direction is block 1. Thus, the two entries shown in FIG. 18 can be filled in.

FIG. 19 assumes switch 5 has not been thrown, and the train progresses from block 2 to block 3. When it crosses into block 3, it can fill in the second entry for block 2, indicating that in that in the clockwise direction (CW) is block 3. Similarly, for block 3, it can indicate that in the counterclockwise (CC) direction is block 2. As can be seen, by having the train continue through all the blocks in the layout, all of the remaining columns and rows can be filled in.

Figures 20, 21:
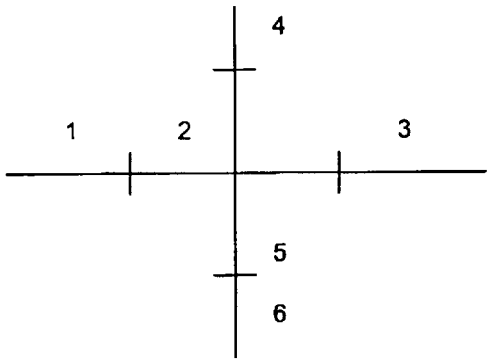
FIG. 20 is a diagram of a crossover block segment according to an embodiment of the invention.
FIG. 21 is a diagram of a portion of a table corresponding to the crossover of FIG. 20.

FIGS. 20 and 21 indicate a crossover and the table entries corresponding to it. Blocks 2 and 5 in FIG. 21 have entries similar to those discussed above, except that they also have an indirect entry. Block 2 has an indirect entry 5, indicating that a train in block 2 means that there can not also be a train in the indirect block 5 without the potential for a collision. Similarly, block 5 indicates in its indirect column block 2.

Figure 22:
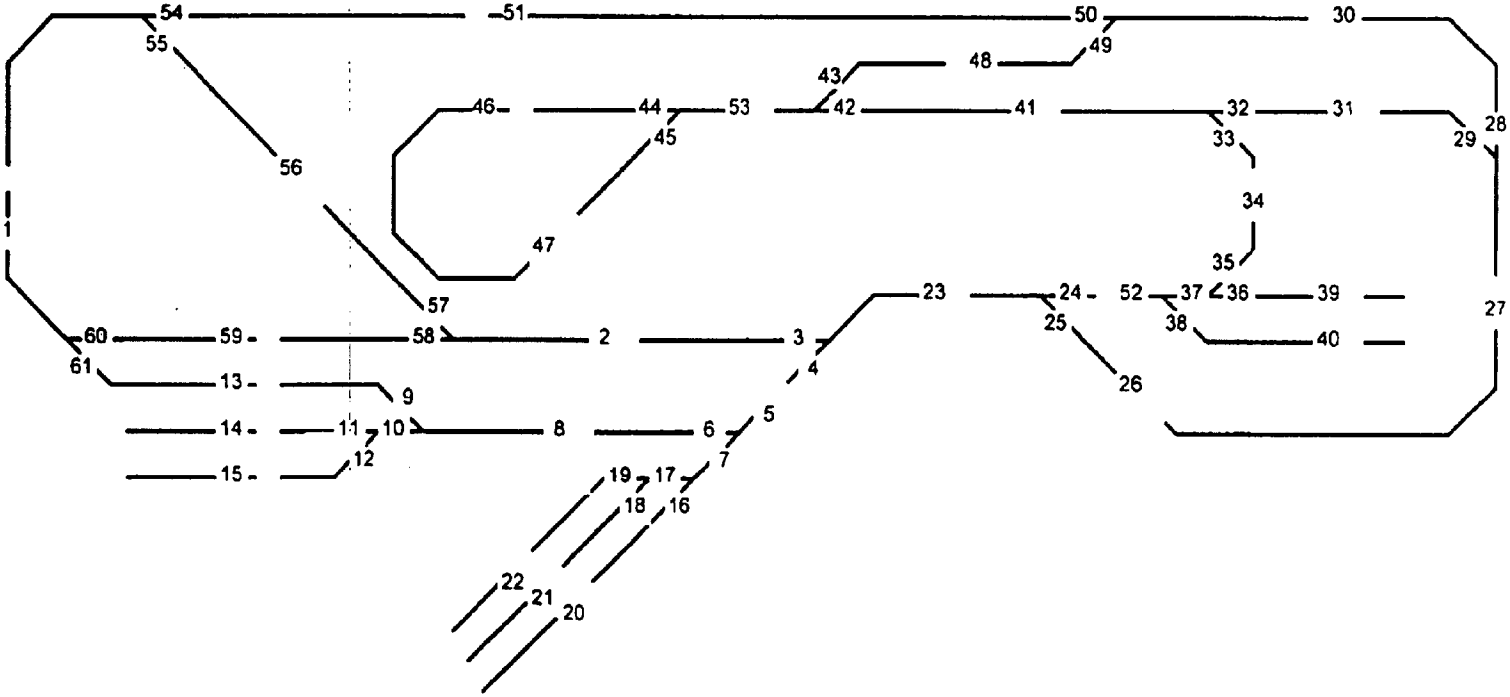
FIG. 22 is an example layout according to an embodiment of the invention, showing an example of a graphical display.

FIG. 22 is an example of a somewhat complex track layout with multiple blocks and switches. FIG. 23 indicates the entries, corresponding to those discussed above, for all of these blocks and switches from 1–61. In this example, there are no indirect blocks, and accordingly this column is left off. As can be seen from the numbers in the first row, all of the elements are either blocks or switches. For example, the third row is a switch corresponding to number 3 in FIG. 22. As can be seen, for switch 3 in the counterclockwise direction is block 2, with no other option, and thus a 0 in the next column. In the clockwise direction is only block 23 and not block 24 since a train coming from 2 to switch 3 can not be switched onto block 4 because of the extreme angle.

The controller in one embodiment contains pattern recognition algorithms. This allows recognition of loops, sidings, reverse loops, single and double ended tracks, etc. This patterns can be displayed on a monitor with a graphical representation of the track, and also can be used for route determination.

Operational Control, Collision Avoidance

The controller 14 can emit commands to the receivers and actuators based, at least in part, on the address information stored in memory. The controller 14 can emit commands to one or more receivers 12 or actuators 13. The commands issued by the controller 14 can coordinate the movement of one or more cars 16 moving along the path 18 to prevent collisions between the cars 16. The commands can also control the operation of any other device in proximity of the path 18 such as track switches, light generating devices, sound generating devices, and motion generating devices. The following are examples that illustrate some of the actions that can be performed by the controller 14:

EXAMPLE 1

Figure 14A:
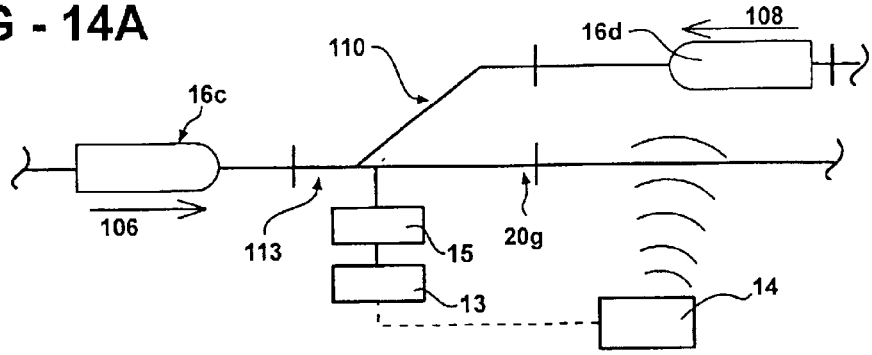
FIGS. 14A–E are illustrations of events that can be controlled by a controller according to an embodiment of the present invention.

As shown in FIG. 14A, two cars 16*c* and 16*d* can approach a switch section 20*g* of track moving in opposite directions 106 and 108. The controller 14 can stop the movement of the car 16*d* before the car 16*d* reaches the switch section 20*g*. The controller 14 can emit a command to an actuator 13 to move a switch 15 and prevent the car 16*c* from following the section 110 of the switch section 20*g*. The controller 14 can also emit wave signals to stop or slow the car 16*d* to reduce the likelihood that the cars 16*c* and 16*d* will collide. Subsequent to the movement of the car 16*c* past the switch section 20*g,* the controller 14 can engage the car 16*d* to move in the direction 108 to the switch section 20*g* and section 113.

EXAMPLE 2

Figure 14B:
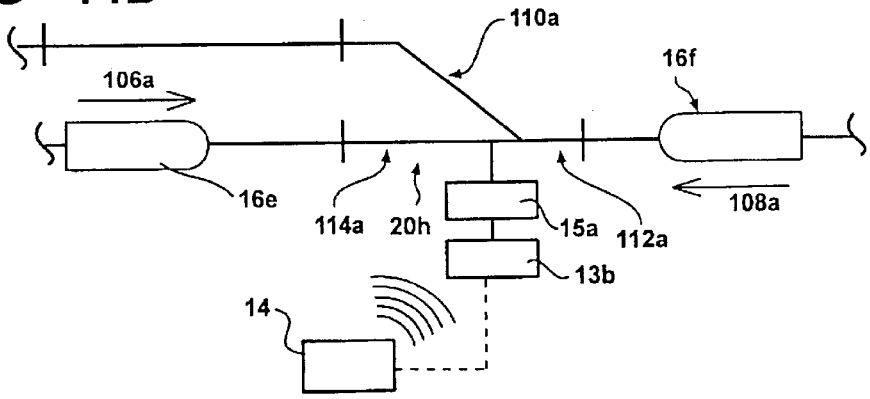

As shown in FIG. 14B, two cars 16*e* and 16*f* can approach a switch section 20*h* of track moving in opposite directions 106*a* and 108*a,* respectively. The controller 14 can emit a command to an actuator 13*b* to move a switch 15*a* and prevent the car 16*f* from moving to the section 114*a* of the switch section 20*h*. The car 16*f* will follow the section 110*a* to the end 42*a* and be stopped by a wave signal emitted by the controller 14. The car 16*e* will move past the switch section 20*g,* along section 112*a* in the direction 106*a*. The controller 14 will then move the car 16*f* in a reverse direction with respect to direction 108*a,* returning the car 16*f* to the section 112*a*. The controller 14 can then switch the switch section 20*h* and move the car 16*f* in the direction 108*a,* past the switch section 20*h* and section 114*a*.

If necessary, the controller 14 can also modify the velocities of the cars 16*e* and 16*f* as the cars approach the switch to ensure that the car 16*f* can reach the end 42*a* before the car 16*e* reaches the switch section 20*h*. In addition, the controller 14 can also determine the number and configuration of cars being pulled by the car 16*f* to ensure that the length of the series of cars will fit in the passing area.

EXAMPLE 3

Figure 14C:
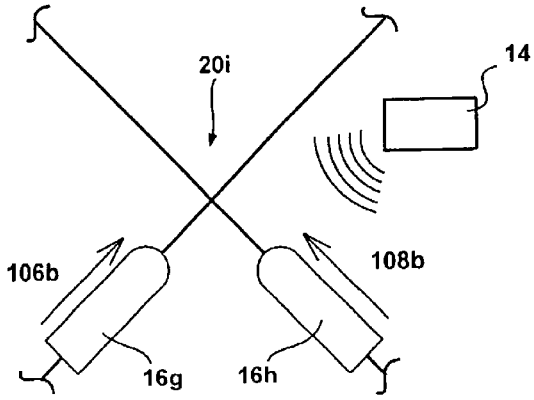

As shown in FIG. 14C, two cars 16*g* and 16*h* can approach a x-section 20*i* of track moving in different directions 106*b* and 108*b,* respectively. The controller 14 can control the movement of the cars 16*h* and 16*g* with wave signals to avoid a collision between the cars 16*h* and 16*g*.

Accessory Control

The present invention thus provides a system for uniquely identifying a particular train by its ID, and what block of the layout it is positioned at by the sensors or position indicators on the track. This provides additional capabilities. For example, the controller can store in its memory what type of train each ID corresponds to. Accessories positioned around the layout can respond to the type of trains which come by. For example, a train platform adjacent a particular block can have the sound come on for a train arrival announcement only when passenger trains arrive at that block. When a train approaches that station, and spots the position identifier, it provides a signal, or a sensor provides a signal, back to the controller with the train ID. The controller can then look up in its memory the type of train to determine if it is a passenger train, and determine if there is a platform nearby which has been programmed to emit the sound upon the approach of passenger trains. If there is a match, the sound will be activated.

Automated Accessory and Switch Control

In one embodiment, the present invention presents an accessory or switch to the user for the user to control. In existing systems, a user may need to first select which switch, then determine which direction to throw the switch. Similarly, the user may need to select a particular accessory, then select one of multiple options for operation of that accessory. The system of this invention can automatically determine the next switch and accessory to be encountered by the vehicle base on its direction and location on the track layout. The next switch is then allocated to a switch button on a hand-held controller, or is associated with a first switch on another type of controller. The next accessory can be allocated to an accessory button. Thus, the user doesn't need to search through and select the switch and accessory, but merely needs to determine what to do with them. And, in the fully automatic option described above, the need to select the option could also optionally be automated.

Thus, the present invention enables the automatic activation of appropriate accessories on a discriminating basis, without requiring active intervention by the operator. The operator can set these up in advance by appropriate programming, thus being free to concentrate on other things during operation of the train system.

Other examples of accessories could include a dog which barks only when red engines go by. Another example might be a crane for loading only freight trains having the type of cars to be loaded. In one embodiment, the sensor either on the track or on the train could be in a particular car of the train, as opposed to the engine.

EXAMPLE 4

Figure 14D:
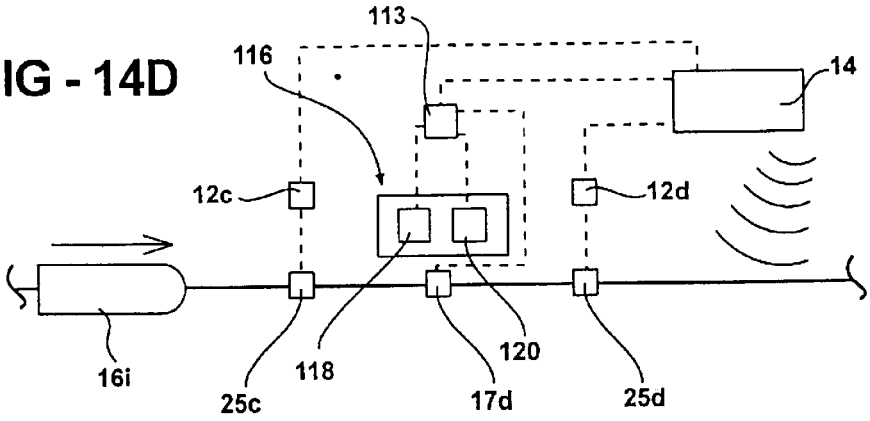

As shown in FIG. 14D, a car 16*i* can approach an model train accessory, such as a model train station 116. The station 116 can include a light generating device 118 and a sound generating device 120 in communication with an actuator 13*d*. Although not shown in FIG. 14D, in an alternate embodiment of the present invention the station 116 can include only a light generating device 118 or only a sound generating device 120. Furthermore, the station 116 can include a motion generating device to, for example, open doors or windows at the station 116. In addition, accessories other than a station 116 can be practiced in the present invention.

In proximity to the path 18 are two receivers 12*c* and 12*d* having detectors 25*c* and 25*d,* respectively. Actuator 13*d* includes detector 117*d*. The receiver 12*c* communicates to the controller 14 when the car 16*i* comes into proximity with the detector 25*c*. The controller 14 can emit a command to the actuator 13*d* to engage light generating device 118 and generate light. For example, the station 116 can be illuminated by the proximity of the car 16*i* as a real station would be illuminated by the arrival of a real train.

In addition, the controller 14 can emit a command to the actuator 13*d* to engage sound generating device 120 to emit a predetermined sound. For example, the sound generating device 120 can emit an announcement that the car 16*i* has arrived. Furthermore, the controller 14 can emit commands to the actuator 13*d* to engage the sound generating device 120 to emit one of several different sounds. Since the controller 14 can uniquely identify each model train moving along the path 18, the controller 14 can emit a command to the actuator 13*d* to engage the sound generating device 120 to emit sounds associated with car number or car type of car 16*i*. For example, the sound generating device 120 can be commanded to emit an announcement that the car 16*i* has arrived rather a generic announcement that a car has arrived.

The controller 14 can also control movement of the car 16*i* with a wave signal to stop the car 16*i* at a desired position adjacent the station 116. For example, the controller 14 can control the car 16*i* to stop when the car 16*i* comes into proximity with the detector 117*d* or detector 25*d*. If the car 16*i* is pulling other cars, the car 16*i* can be stopped so that pulled cars would be immediately adjacent the station 116 as real cars would be adjacent a real station.

The controller 14 can also control the car 16*i* to move past the station 116 without stopping if, for example, the car 16*i* is not pulling any other cars. Also, if the car 16*i* is a cargo train pulling cargo cars and the station 116 is designated as a passenger station, the car 16*i* can be moved past the station 116 to an area of the path 18 designated for cargo activity such as loading and unloading.

EXAMPLE 5

Figure 14E:
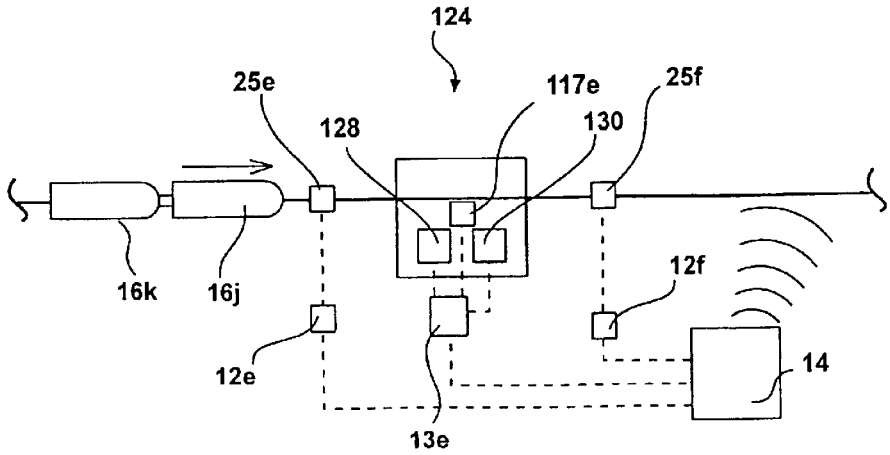

In FIG. 14E, a representative cargo activity is schematically represented. The car 16*j* is moving along the path 18 pulling a cargo car 16*k*. The cars 16*j* and 16*k* approach a cargo transferring station 124. The station 124 includes a motion generating device 128 and a sound generating device 130. The motion generating device 128 and a sound generating device 130 are engaged by actuator 13*e* in communication with the control 14. Although not shown, the station 124 can include a light generating device and need not include a sound generating device 130. The controller 14 can slow the car 16*j* with wave signals as the car 16*j* moves toward the station 124 and stop the car 16*j* when the car 16*k* comes into proximity with the detector 117*e*. The controller 14 can emit a command to the actuator 13*e* to move the motion generating device 128 to add or remove cargo from the car 16*k*. The actuator 13*e* can communicate with the controller 14 when the cargo transferring activity has been completed. The controller 14 can then engage the car 16*i* to move away from the station 124.

The examples provided above are illustrative and the controller is not limited to the operations described in the examples. The variety of known model railroad accessories and known activities occurring in model railroad systems cannot be fully described, but the method and apparatus of infrared communication described herein can be practiced with any of these accessories or activities currently known in the model railroad art.

The present invention also provides input means for controller 14. Input means can be used by a model railroader to control the operation of one of the cars 16 moving along the path 18 while the controller 14 controls the movement of the other cars 16 moving along the path 18.

Train Length Indication

In one embodiment, the caboose or trailing car of a train can have a marker or sensor so that the passage of both the beginning and end of a train can be determined. This could be done constantly, or could be done once with the length of the train being stored in memory. This allows, for example, an intelligent determination of whether the train will fit on a siding so that the controller can present available options to an operator for moving the train. Similarly, based on the train speed as transmitted to the controller and its length, a determination can be made of how long it will take for the train to pass over a switch or crossover, thereby determining when a train on a collision course can safely approach. This could either provide a warning to the operator, or could automatically slow down the other train the appropriate amount of time to allow passage at the current speed of the first train.

Automated Route Generation

In one embodiment, once a layout of the track has been determined as discussed above, the controller can automatically present route options to an operator. For example, the operator can simply input the desired starting and ending locations, and the controller can provide a graphical display illustrating the available routes. In one embodiment, the routes can be ranked or listed according to certain criteria. For example, the route with the minimum number of reversals required in order to get the train to its destination can be set forth. Another type of route might specify how a train can arrive in reverse, so that the cars can be backed in to an unloading station, for example. The controller can provide facing point moving routes and trailing point moving routes.

Alternate Roadways

As used herein, the term "track" is intended to refer to not only a train track, but a roadway or other transportation path, such as a flight path in three dimensions. For example, instead of a track, a road race game can have multiple road blocks with similar switching and crossovers. Additionally, multiple lanes could be routed on the roadway, instead the sidings often available in a railroad track layout. Sensors could determine not only what roadway block the car is on, but also the lane it is in.

Fine Distance Measurement

A rotary encoder on the vehicle can be used to further define the position of the engine or car between blocks. The sensors are used to reset the position of the vehicle location. As the wheels turn, the fractional part of the revolution is recorded. So, for example, distance can be described as 3 revolutions and 20 ticks past sensor 4 (where 4 is the last sensor passed, 3 is the number of complete rotations of the counting wheel located on the vehicle and 20 is the number of pulses in the fractional revolution).

While the invention has been described in connection with a particular embodiment, it is to be understood that the invention is not to be limited to the disclosed embodiments. For example, the transmission to the controller could be from the vehicle (train) or a sensor. The transmission from the train could be wireless, or could be transmitted electrically through the wheels of the train as a signal along the track to the controller. Accordingly, the invention is intended to cover various modifications and equivalent arrangements included within the scope of the appended claims, which scope is to be accorded the broadest interpretation so as to encompass all such modifications and equivalent structures as is permitted under the law.

What is claimed is:

1. A method for initially determining the layout of at least a portion of a track, comprising:

providing a plurality of position detection elements for use in detecting a vehicle on multiple blocks of said track, each of said position detection elements being associated with a different one of said blocks;

moving said vehicle along said multiple blocks of said track; and recording, without said layout being pre-stored, the interconnection of said blocks to determine said layout.

2. The method of claim 1 further comprising:

providing an ID from each of said position detection elements; and associating said ID with one of said blocks of said track.

3. The method of claim 1 further comprising:

determining a direction of said vehicle; and recording adjacent block locations in accordance with said direction.

4. The method of claim 1 further comprising:

moving said vehicle through each of the positions of a track switch;

determining a block corresponding to each position of said track switch from a position detection element detection after said vehicle passes said switch.

5. The method of claim 1 wherein said position detection elements are sensors, and further comprising:

detecting said vehicle on one of said blocks from a signal from one of said sensors.

6. The method of claim 1 further comprising:

detecting said vehicle on one of said blocks from a signal from said vehicle, wherein said vehicle detects said position detection element.

7. The method of claim 1 wherein said recording further comprises:

building a table of blocks, with adjacent blocks on each side, from sequential detections of blocks in each direction.

8. A method for initially determining the layout of at least a portion of a track, comprising:

providing a plurality of position detection elements for use in detecting a vehicle on multiple blocks of said track, each of said position detection elements being associated with a different one of said blocks;

moving said vehicle along said multiple blocks of said track;

recording, without said layout being pre-stored, the interconnection of said blocks to determine said layout;

providing an ID from each of said position detection elements;

associating said ID with one of said blocks of said track;

determining a direction of said vehicle;

recording adjacent block locations in accordance with said direction;

moving said vehicle through each of the positions of a track switch; and determining a block corresponding to each position of said track switch from a position detection element detection after said vehicle passes said switch.

9. An apparatus for initially determining the layout of at least a portion of a track, comprising:

a plurality of position detection elements for use in detecting a vehicle on multiple blocks of said track, each of said position detection elements being associated with a different one of said blocks;

a vehicle which is movable along said multiple blocks of said track;

a transmitter for sending information about said vehicle and said position detection element; and a controller configured to receive said information and record the interconnection of said blocks, without said layout being pre-stored, to determine said layout.

10. The apparatus of claim 9 further comprising:

a direction detector for detecting a direction of said vehicle; and said transmitter being configured to transmit said direction to said controller.

11. The apparatus of claim 10 wherein said direction detector is said position detection element.

12. The apparatus of claim 9 further comprising:

a speed detector for detecting a speed of said vehicle.

13. The apparatus of claim 9 wherein said transmitter is connected by a wire to said controller, and is configured to transmit signals on said wire.

* * * * *